United States Patent [19]

Yamada et al.

[11] 4,377,345

[45] Mar. 22, 1983

[54] ALARM SIGNALING CIRCUIT FOR TIMEPIECE

[75] Inventors: Shinji Yamada; Mitsuru Nagoya, both of Kitakatsushika, Japan

[73] Assignee: Rhythm Watch Company, Limited, Tokyo, Japan

[21] Appl. No.: 219,884

[22] Filed: Dec. 24, 1980

[30] Foreign Application Priority Data

Dec. 28, 1979 [JP] Japan ..... 54-170967

[51] Int. Cl.[3] ..... G04B 23/02; G04C 21/00

[52] U.S. Cl. ..... 368/245; 368/250; 368/273

[58] Field of Search ..... 368/72–75, 368/243–245, 250, 251, 272, 273; 340/384 E

[56] References Cited

U.S. PATENT DOCUMENTS

| | | | |
|---|---|---|---|
| 4,098,071 | 7/1978 | Kawakami et al. | 368/73 |
| 4,104,865 | 8/1978 | Sasaki | 368/245 |
| 4,203,278 | 5/1980 | Kondo et al. | 368/245 |
| 4,234,944 | 11/1980 | Komari et al. | 368/245 |
| 4,255,803 | 3/1981 | Sekine | 368/251 |
| 4,271,495 | 6/1981 | Scherzinger et al. | 368/245 |

*Primary Examiner*—Vit W. Miska

*Attorney, Agent, or Firm*—Koda and Androlia

[57] ABSTRACT

An alarm signaling circuit for a timepiece including a volume control circuit having a variable volume controller which can be externally adjusted and a fixed volume setting means which determines a constant volume, a change over switch which selectively changes the controller and the setting means, and a change over control circuit which has a time section for measuring an alarm signalling time and which supplies a change over control signal to the change over switch after a predetermined passage of time from the start of alarm signaling. The alarm signaling circuit performs the alarm signaling action at a certain volume established by the variable volume controller during a first alarm signaling period from a start of alarm signaling till the predetermined passage of time and further performs the alarm signaling action at a fixed alarm volume determined by the fixed volume setting means in a consecutive second alarm signaling period.

6 Claims, 2 Drawing Figures

ALARM SIGNALING CIRCUIT FOR TIMEPIECE

BACKGROUND OF THE INVENTION

1. Field of the Invention

This invention relates to an alarm signaling circuit for a timepiece, and in particular to an alarm signaling circuit which can externally control the volume of the alarm of the timepiece.

2. Prior Art

In accordance with the electronization of timepieces, an alarm signaling circuit has been recently electronized to perform alarm signaling at a preset time by a preset electronic sound of a melody. In such a kind, the electronic timepiece with alarming means there is a well-known means which can optionally determine the volume of the alarm and the volume of the alarm can be optionally selected in accordance with the user's choice of using conditions. For example, a loud alarming sound can be set for a wake-up call and a soft alarming sound can be set for an appointment set up time during the day time. Such usage of the alarm timepiece can enlarge its scope of utilization and apply effective alarming action.

The conventional means of this kind which requires one to determine the volume of the alarm depending on the using situation is inconvenient to use in an actual situation. When alarming action is required for waking up, there is a tendency that the alarming volume be selected louder than required, and the alarming volume control becomes meaningless. When the volume of the alarm is set to be soft for an appointment set-up time during the daytime, it is often left in this soft condition when it is to be used for a wake up call. As a result, the volume of the alarm is too soft to wake up the user and the alarming action is not sufficient. Accordingly, in the conventional alarming means there is a problem in that the alarm signaling circuit capable of alarming volume control cannot be applied sufficiently.

SUMMARY OF THE INVENTION

Accordingly, it is a general object of the present invention to provide an alarm signaling circuit for a timepiece which can improve the operational ability of an electronic timepiece with alarm volume control.

In keeping with the principals of the present invention, the object is accomplished with an alarm signaling circuit for a timepiece which, in an alarm signaling circuit for a timepiece capable of external and optional determination of the alarming volume, includes a volume control circuit having a variable volume controller which can be externally adjustable and a fixed volume setting means which determines a constant volume, a change over switch which selectively changes the controller and setting means and a change over control circuit which has a time section measuring an alarm signaling time and supplies a change over control signal to the change over switch after a predetermined passage of time from the start of the alarm signaling. The change over control circuit performs the alarm signaling action at a certain volume established by the variable volume controller during the first alarm signaling period from the start of alarm signalling till the predetermined passage of time and further performs the alarm signalling action at a specific alarm volume determined by the fixed volume setting means in the following alarm signaling period.

BRIEF DESCRIPTION OF THE DRAWINGS

The above mentioned and other features and objects of the present invention will become more apparent with reference to the following description taken in conjunction with the accompanying drawings in which.

DETAILED DESCRIPTION OF THE INVENTION

Figure 1:
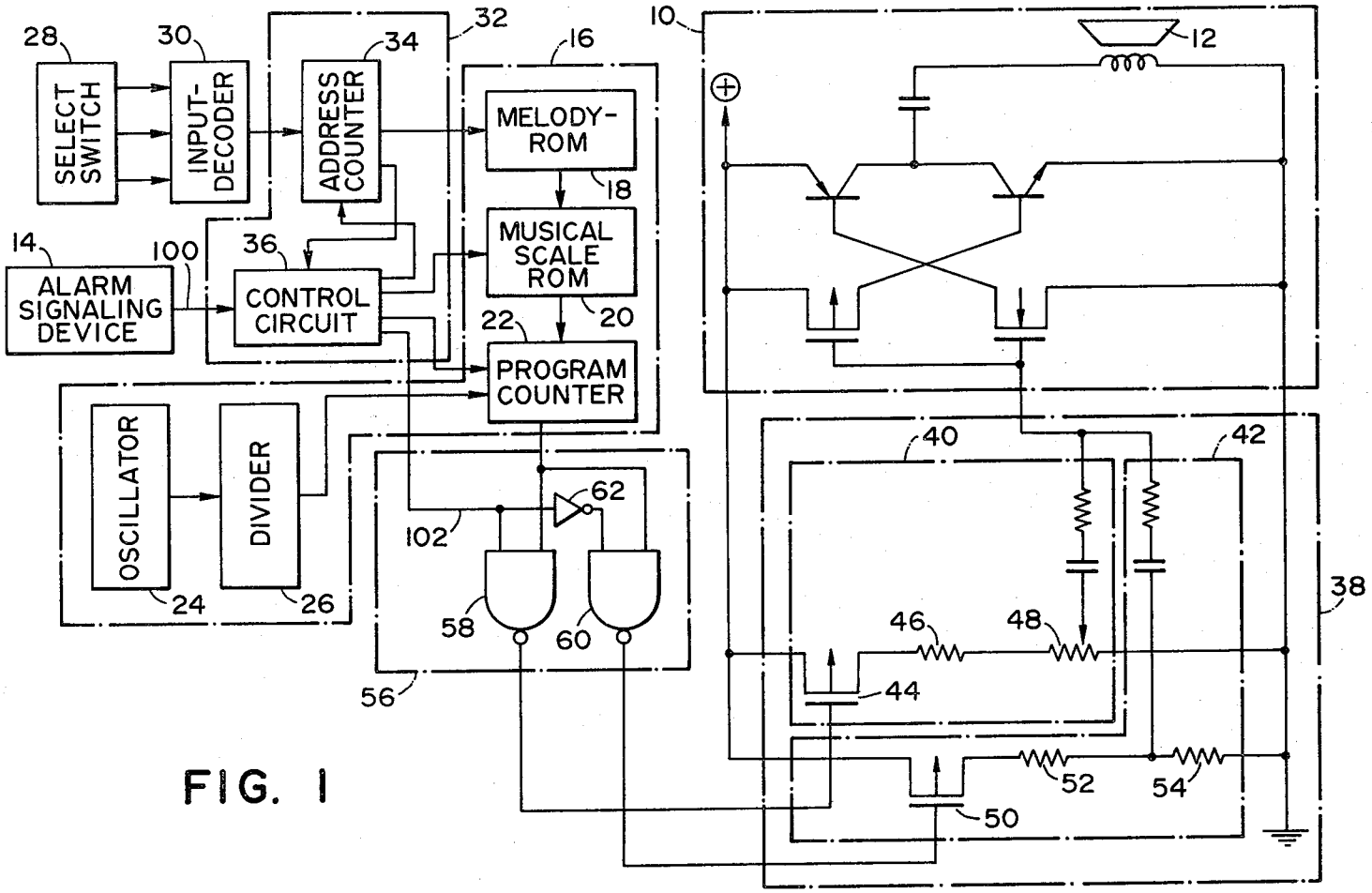
FIG. 1 is a block diagram showing a preferred embodiment in accordance with the teachings of the present invention.

Referring more particularly to the drawings, shown in FIG. 1 is a block diagram of a preferred embodiment in accordance with the teachings of the present invention. The electronic timepiece includes an alarm sound generating circuit 10 and a speaker 12 which produces a preset alarm sound. In the embodiment, the alarm sound consists of a plurality of melodies and electronic sounds and the preset alarm action is selectively performed in the predetermined alarming time by an alarm signaling device 14.

In order to form the present alarming sound, provided is an alarm sound signal generating circuit 16. In the embodiment, the alarm sound signal generating circuit 16 includes a melody ROM 18, a musical scale ROM 20, a program counter 22, an oscillator 24 and a divider 26. The melody ROM 18 memorizes data of the values of musical notes and electronic sounds. The musical scale ROM 20 is formed by a circuit putting the musical note data from the melody ROM 18 to the program counter 22 as an addressing signal and a dividing ratio selecting signal. The program counter 22 consists of a circuit for dividing a frequency signal provided by the divider 26 and outputed from the oscillator 24 at the dividing ratio selection by the musical scale ROM 20, and outputs the alarm sound signal to form the predetermined melody and electronic sound.

The present invention is characterized in the alarm signaling actions of different alarm volumes between the first alarm signaling period from the start of alarm signaling till a certain time passage and the second alarming signaling period following the first period. In the embodiment, the alarm signaling action of different tones is performed in both alarm signaling periods. In other words, in the first alarm signaling period is signaled an alarm sound optionally selected from a plurality of melody sounds memorized in the alarm sound signal generating circuit 16; and in the following second alarm signaling period is performed alarm signaling by the electronic sound of the alarm sound signal generating circuit 6.

A select switch 28 is provided to select the requested melody from a plurality of melody alarm sounds in the first alarm signaling period, and the selected signal is supplied to an address counter 34 of a change over control circuit 32 by way of an input decoder 30 to address the address counter 34 to start the selected melody of the melody ROM 18. The address counter 34 does not read only the data of the melody ROM 18 out of the start address of the melody ROM 18 addressed by the input decoder 30, but also forms a timer section out of the change over control circuit 32 to time the passage of time from the start of alarm signaling action by the counter value at the counter.

The change over control circuit 32 includes control circuit 36 for generating a starting signal of operation in response to the signal from an alarm signaling device 14 to the address counter 34, the melody ROM 18 of the alarm sound signal generating circuit 16, the musical scale ROM 20 and the program counter 22 to control the requested alarm sound signaling, and for generating a volume change over control signal in response to the predetermined time passage signal from the address counter 34 forming the timer section.

A volume control circuit 38 is provided to control the volume of the alarm of the alarm sound generating circuit 10 and the volume control circuit 38 includes a variable volume controller 40 includes an FET 44, fixed resistor 46 which is connected to the FET 44, and a variable resistor 48 whose amount of resistance can be optionally controlled from the outside. Accordingly, supply of the alarm sound signal from the alarm sound signal generating circuit 16 to the alarm sound generating circuit 10 by way of the variable volume controller 40 of the volume control circuit 38 can optionally control the alarm volume by way of the variable resistor 48. On the other hand, the fixed volume setting means 42 consists of a FET 50 and fixed resistors 52 and 54. Since the numerical values of this circuit are prefixed in assembly, it is understood that supply of the alarm sound signal to the alarm sound generating circuit 10 by way of the fixed volume setting means 42 established a predetermined volume of the alarm sound.

A change over switch circuit 56 is provided to selectively change over both the controller 40 and the setter 42 of the volume control circuit 38 and includes NAND gates 58 and 60, both outputs of which are supplied to the respective gates of the transistor 44 of the variable volume controller 40 and the FET 50 of the fixed volume setting means 42. To one input of both NAND gates 58 and 60 is supplied the alarm sound signal of the alarm signal generating circuit 16 from the programe counter 22, and to the other input of both gates 58 and 60 is supplied in the output of the change over control circuit from the control circuit 36 directly and by way of an inverter 62 respectively.

Figure 2:
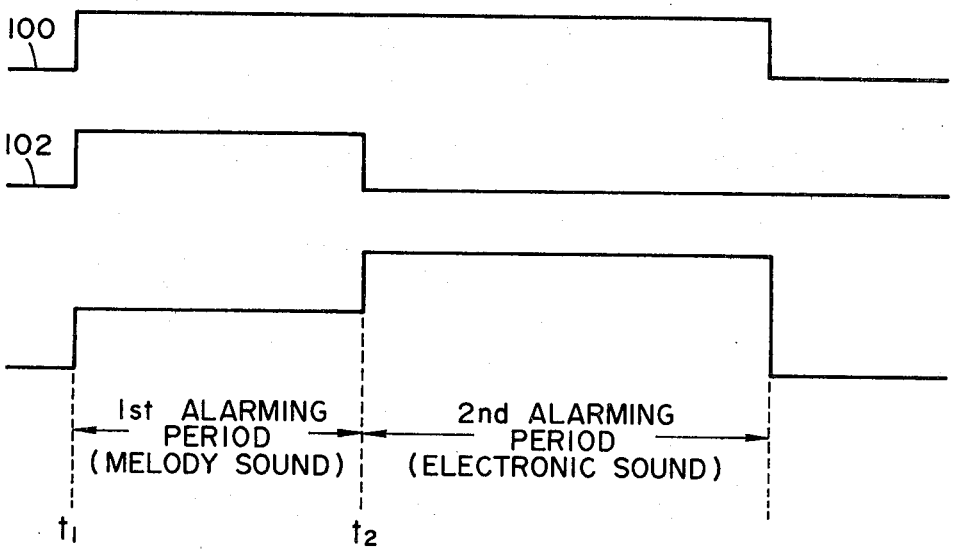
FIG. 2 is a time chart of FIG. 1.

The embodiment of the present invention is composed as described heretofore, and the operation is described in the following with reference to the timing of FIG. 2.

At the time t1, when the alarming signal is supplied to the control circuit 36 of the change over switch 32, the starting signal of operation is supplied from the control circuit 36 to the address counter 34 and the alarm sound signal generator 16. Consequently, the address counter 34 reads the data of musical notes one after another from the start address of the melody sounds selected by the select switch 28 and the data of musical notes is supplied from the musical scale ROM 20 to the program counter 22 to be further supplied to both NAND gates 58 and 60 of the change over switch 56 as the alarm sound signal. On the other hand, at the time t1, since the signal 102 is supplied from the control circuit 36 to the NAND gate of the change over switch to open gate 58, the alarm sound signal of the alarm sound signal generating circuit 16 is supplied from the NAND gate to the variable volume controller 40 of the volume control circuit 38. In the first alarm signaling period from the time t1, therefore, the alarm signalling action is performed at the volume determined by the volume controller 40.

After a predetermined passage from the time of t1 when the alarm signaling action is started by the operation of the address counter 34 forming the timer section, the timer signal is supplied from the address counter 34 to the control circuit 36. Consequently, at the time t2, the change over control signal is supplied from the control circuit 36 to the change over switch 56. In other words, at the time t2, the signal 102 is inverted into a "L" level to close the NAND gate 58 of the change over switch 58 and to open the NAND gate 60. Accordingly, after passage of the first alarm signaling period (t1 to t2), the alarm sound signal from the alarm sound signal generating circuit 16 is provided to the fixed volume setting means 42 of the volume control circuit 38, and the alarm signaling action is performed at the volume determined by the fixed volume setting means 42 in the second alarm signaling period. In this embodiment, in the second alarm signaling period, the alarm sound signal generating circuit 16 output an electronic sound signal to perform the alarm signaling action which is different in tone from the first alarm signaling period.

As described in the above, according to this embodiment, in the first alarm signaling period from the start of the alarm signaling action till predetermined passage of time, the melody alarm signaling action is performed at the volume externally determined, and, in the following second signaling period, the alarm signaling action of electronic sound is performed at the fixed volume.

In this embodiment, between the first and the second alarm signaling periods, the alarm signaling actions are performed in the different tones, but it is possible in the present invention to perform both of signaling actions in the same tone and to have the alarm sounded as a melody sound or as an electronic sound independently or in combination.

As described heretofore, according to the present invention, since the alarm signaling action is automatically performed at the determined volume after a predetermined passage of time from the start of the alarm signaling action, the alarm volume in the first alarm signaling period can be optionally determined by the user. For example, in case the alarm volume of the first alarm signaling period is too small for waking up, the alarm signaling action in the second period can be fixed for waking up. Furthermore, as described in the embodiment, the different tone of alarming action between the first and the second alarm signaling periods can prevent users from getting accustomed to the alarm sound and the present invention can provide a handy and convenient electronic timepiece in practical use.

I claim:

1. An alarm signaling circuit for a timepiece having settable first and second alarm signal periods and which is capable of external and optional determination of alarming volume comprising:

a volume control circuit having a variable volume controller which can be externally adjustable and a fixed volume setting means which determines a constant volume;

a change over switch which selectively changes between said volume controller and said fixed volume setting means in response to a change over control signal; and a change over control circuit which has a timer section for measuring alarm signaling time and for supplying said change over control signal to said change over switch after a predetermined passage of time from a start of an alarm signaling;

whereby alarm signaling action at a certain volume is established by said variable volume controller during said first alarm signaling period and alarm signaling action at a fixed alarming volume is determined by said fixed volume setting means in a consecutive said second alarm signaling period.

2. An alarm signaling circuit for a timepiece according to claim 1, wherein the alarm signaling action is performed in a different tone between the first alarm signaling period and the second alarm signaling period.

3. An alarm signaling circuit for a timepiece according to claim 2, wherein an alarming action is performed in melody sounds optionally selected from a plurality of melody sounds during the first alarm signaling period, and an alarm signaling action is performed in electronic sounds in the second alarm signaling period.

4. An alarm signaling circuit for a timepiece according to claim 1, wherein alarming signal is formed by an oscillator, a divider for dividing frequency signals from said oscillator, a program counter for dividing the frequency signal from said divider to output a predetermined signal, a ROM memorizing numerically valued data, and a musical scale ROM providing alarm signaling data from said melody ROM to said program counter as an addressing signal and a signal selecting the dividing ratio.

5. An alarm signaling circuit for a timepiece according to claim 1, wherein said volume controller comprises an FET, fixed resistors connected to said FET, and a variable resistor having its amount of resistance optionally controlled externally to said timepiece.

6. An alarm signaling circuit for a timepiece according to claim 1, wherein said fixed volume setting means includes an FET and two fixed resistors connected to said FET.

* * * * *